US009340924B2

(12) United States Patent
Struwe et al.

(10) Patent No.: US 9,340,924 B2
(45) Date of Patent: May 17, 2016

(54) CABLE WITH ELECTRICAL CONDUCTOR INCLUDED THEREIN

(75) Inventors: Hansjorg Struwe, Mitteleschenbach (DE); Rudolf F. Kirst, Bremen (DE)

(73) Assignee: Helukabel GmbH, Windsbach (DE)

( * ) Notice: Subject to any disclaimer, the term of this patent is extended or adjusted under 35 U.S.C. 154(b) by 924 days.

(21) Appl. No.: 12/738,790

(22) PCT Filed: Oct. 20, 2008 (Under 37 CFR 1.47)

(86) PCT No.: PCT/DE2008/001713

§ 371 (c)(1), (2), (4) Date: Aug. 6, 2010

(87) PCT Pub. No.: WO2009/049616

PCT Pub. Date: Apr. 23, 2009

(65) Prior Publication Data

US 2011/0132660 A1 Jun. 9, 2011

(30) Foreign Application Priority Data

Oct. 19, 2007 (DE) ..... 10 2007 050 402

(51) Int. Cl.

*H02G 15/02* (2006.01)
*H02G 15/04* (2006.01)
*H01B 11/02* (2006.01)

(Continued)

(52) U.S. Cl.

CPC *D07B 1/147* (2013.01); *D04C 1/12* (2013.01); *D07B 7/16* (2013.01); *D07B 1/025* (2013.01); *D07B 5/12* (2013.01); *D07B 2201/1096* (2013.01); *D07B 2201/2095* (2013.01); *D07B 2205/205* (2013.01); *D07B 2205/2014* (2013.01); *D07B 2205/2042* (2013.01); *D07B 2207/4045* (2013.01); *D07B 2401/201* (2013.01); *D07B 2501/406* (2013.01)

(58) Field of Classification Search

CPC ..... D07B 1/147; D07B 2201/2095; D07B 2501/406; D07B 7/16
USPC ..... 174/74 A, 74 R, 113 C, 113 R
See application file for complete search history.

(56) References Cited

U.S. PATENT DOCUMENTS 2,047,152 A * 7/1936 Mitchell ..... 174/36
2,235,523 A 11/1938 Hull (Continued)

FOREIGN PATENT DOCUMENTS

CH 340430 A 8/1959
DE 284228 C 5/1915

(Continued)

OTHER PUBLICATIONS

International Search Report issued Jul. 5, 2009 during prosecution of International Application No. PCT/DE2008/001713.

(Continued)

*Primary Examiner* — William H Mayo, III
*Assistant Examiner* — Rhadames J Alonzo Miller
(74) *Attorney, Agent, or Firm* — Norton Rose Fulbright US LLP

(57) ABSTRACT

The invention is directed to a braided chemical fibre cable in which at least one electric conductor is contained, in which the cable is thermally stretched together with the conductor contained therein.

14 Claims, 2 Drawing Sheets

(51) Int. Cl.

| | |
|---|---|
| ***H01B 7/00*** | (2006.01) |
| ***D07B 1/14*** | (2006.01) |
| ***D04C 1/12*** | (2006.01) |
| ***D07B 7/16*** | (2006.01) |
| *D07B 1/02* | (2006.01) |
| *D07B 5/12* | (2006.01) |

(56) References Cited

U.S. PATENT DOCUMENTS

| | | | | | |
|---|---|---|---|---|---|
| 2,456,015 | A | * | 12/1948 | Orser | 174/69 |
| 2,940,883 | A | * | 6/1960 | Peirce | 156/598 |
| 3,126,442 | A | * | 3/1964 | Roberts | H01B 7/06 174/113 C |
| 3,153,696 | A | | 10/1964 | Blanchard | |
| 3,530,661 | A | * | 9/1970 | Thomen | 57/6 |
| 3,823,253 | A | * | 7/1974 | Walters et al. | 174/69 |
| 3,932,697 | A | * | 1/1976 | Hood | D07B 1/185 16/108 |
| 4,084,065 | A | * | 4/1978 | Swenson | H01B 7/04 114/243 |
| 4,782,196 | A | * | 11/1988 | Ukai | 174/131 A |
| 4,819,914 | A | | 4/1989 | Moore | |
| 4,871,883 | A | * | 10/1989 | Guiol | 174/36 |
| 4,975,543 | A | * | 12/1990 | Saunders | 174/69 |
| 5,023,405 | A | * | 6/1991 | Kwast | 174/109 |
| 5,166,477 | A | * | 11/1992 | Perin et al. | 174/74 R |
| 5,182,779 | A | | 1/1993 | D'Agostino et al. | |
| 5,500,488 | A | * | 3/1996 | Buckel | 174/102 R |
| 5,749,214 | A | | 5/1998 | Cook | |
| 6,005,191 | A | * | 12/1999 | Tzeng et al. | 174/102 R |
| 6,326,551 | B1 | * | 12/2001 | Adams | 174/113 C |
| 6,495,756 | B1 | * | 12/2002 | Burke et al. | 174/70 R |
| 6,583,360 | B1 | * | 6/2003 | Yudashkin | 174/105 R |
| 6,631,095 | B1 | * | 10/2003 | Bryant et al. | 367/20 |
| 7,007,350 | B1 | * | 3/2006 | Franke | 24/136 R |
| 7,409,815 | B2 | * | 8/2008 | Clough et al. | 57/212 |
| 2002/0189845 | A1 | * | 12/2002 | Gorrell | 174/113 C |
| 2004/0049914 | A1 | * | 3/2004 | Wang et al. | 29/884 |
| 2004/0132366 | A1 | * | 7/2004 | Hiel et al. | 442/43 |
| 2005/0115738 | A1 | * | 6/2005 | Yamaguchi et al. | 174/102 R |
| 2010/0215327 | A1 | * | 8/2010 | Braden et al. | 385/101 |

FOREIGN PATENT DOCUMENTS

| | | | | | |
|---|---|---|---|---|---|
| DE | 1132204 | B | | 6/1962 | |
| DE | 2908732 | A1 | | 9/1979 | |
| DE | 3228297 | A1 | | 3/1983 | |
| DE | 29808030 | U1 | | 9/1999 | |
| DE | 69811121 | T2 | | 11/2003 | |
| EP | 0962945 | A1 | * | 8/1999 | H01B 7/08 |
| EP | 0962945 | A1 | * | 8/1999 | H01B 7/08 |
| EP | 0962945 | A1 | * | 12/1999 | H01B 7/0892 |

OTHER PUBLICATIONS

Written Opinion issued Jul. 5, 2009 during prosecution of International Application No. PCT/DE2008/001713.

International Preliminary Report on Patentability issued May 11, 2010 during prosecution of International Application No. PCT/DE2008/001713.

* cited by examiner

CABLE WITH ELECTRICAL CONDUCTOR INCLUDED THEREIN

CROSS-REFERENCE TO RELATED APPLICATIONS

This application is a national phase filing of PCT/DE2008/001713 filed on Oct. 20, 2008, claiming priority to DE 102007050402.2 filed on Oct. 19, 2007 in Germany.

TECHNICAL FIELD

The invention relates to a braided plastic or chemical fibre cable, in which at least one electric conductor is contained, and a method of producing such a cable.

BACKGROUND OF THE INVENTION

A traction cable with at least one integrated electric cable, such as for transmitting data or supplying electricity, frequently has to satisfy extreme requirements regarding the mechanical, chemical and electric properties, such as minimal weight, maximum breaking strength, minimal susceptibility to torsion, minimal stretching, floatability, fatigue strength under reversed bending stresses, at least two-core electric connection for transmitting data or supplying electricity, and others.

Major problems consist in the fact that a braided cable exerts considerable compressive forces on a centrally disposed coaxial conductor under tensile loads, and that when the load-bearing cable is subjected to the elongation that can occur in practical operation, an electric conductor is exposed to the risk of breaking.

CH340430 discloses a traction cable with an electric cable in which a single-wire or multi-wire electricity cable laid in the core of the cable is surrounded over its entire length by a flexible and crush-proof tube and in this way is protected against the above-mentioned pressure loads. The protective tube does not, however, offer any protection against the risk of breaking of the conductor because of the elongation of the cable described.

The problem of the invention consists in providing a braided chemical fibre cable in which at least one electric conductor is contained, and in which the above-mentioned disadvantages no longer exist, so that the conductor is protected against the effects both of elongation and also of the pressure loads of the cable.

BRIEF SUMMARY OF THE INVENTION

This problem is solved in accordance with the invention with a braided chemical fibre cable in which at least one electric conductor is contained, by thermally stretching the cable together with the conductor contained therein.

Experiments have shown that because of the particular stress situation during the thermal stretching, an intimate positive-fit connection between the two elements occurs, which is accompanied by a permanent deformation of the cable and possibly also of the conductor, i.e. the cable accommodates to the external contour of the conductor, which is at the same time compressed by the compressive forces which occur, acting inwardly, so that when the cable is subsequently subjected to tensile stress in operation, the risk of impairment to the conductor as a result of the compressive forces acting from the outside and also the risk of the conductor's breaking can be reduced substantially or even eliminated virtually completely.

An appropriate embodiment is characterised by the fact that the conductor is braided or coiled around a core. Thanks to this measure, the conductor obtains an elongation reserve, so that there is virtually no risk of breaking any longer.

It may be provided that a cable is contained in the braided cable which has an insulated cylindrical core, an insulating, compressible compensating layer enclosing the core, a braided or coiled conductor on the compensating layer, and an insulating casing layer enclosing the conductor. The arrangement of a compressible compensating layer reduces the effects of the compressive forces of the cable still further. The compensating layer may be resiliently or elastically compressible, such as in the form of a layer of foam.

It may also be provided that a further braided or coiled conductor is arranged on the casing layer, which is enclosed by a further insulating casing layer. The electrical twin-wire structure formed in this way offers advantages when transmitting data and supplying electricity.

A protective film of plastic my be disposed between the conductor and the casing layer, especially consisting of PTFE, optionally with a corresponding further protective film between the further conductor and the further casing layer. These films serve to provide security in case the insulation capacity of the casings is impaired by the stretching process.

The compensating layer may consist of foamed or unfoamed plastic, such as a thermoplastic elastomer or a combination of an elastomer and a thermoplastic material (two-phase system).

It may be provided that at least one casing layer consists of an extruded plastic, especially a thermoplastic material or a thermoplastic elastomer. It is conveniently provided that the core includes a support element in the form of a monofilament and a core layer extruded onto it.

The invention envisages that the cable containing the at least one conductor is stretched at a temperature of between 60° C. and 200° C., especially at 90° C. to 130° C.

In this context, it is convenient for the cable to be subjected to a stretching force of between 1% and 50% and especially 20% to 30% of the tensile strength of the cable. The braided cable, together with the conductor or cable contained within it, can be subjected to a stretching ratio of 3%, 5%, 7%, 9%, 10%, 15% or more, "stretching ratio" meaning the increase in the length of the stretched cable, based on the initial length.

The problem of the invention is further solved by a method of producing a plastic cable with an electric conductor contained therein, comprising the steps of: a) providing an electric conductor, b) arranging a plastic cable around the conductor, and c) thermally stretching the cable containing the conductor.

Step a) may comprise the following steps: a1) providing an insulating core, a2) extruding a compressible compensating layer around the core, enclosing the core, a3) arranging a braided or coiled electric conductor on the compensating layer, a4) extruding an insulating casing layer around the conductor enclosing the conductor, especially consisting of a thermoplastic elastomer.

Step b) may contain a laid, twisted or braided cable (e.g. round braiding, cladded-core cable, multi-core cable), which may optionally have a protective jacket braided and/or coated over it and may comprise 3, 4, 6, 8, 12, 16, 20, 24, 32 or 48 strands.

It is preferably provided that the cable is stretched at a temperature of between 60° C. and 200° C., especially 90° C. to 130° C. The cable is preferably stretched at a stretching ratio as specified above.

As a further modification of the invention, it can be provided that the following steps are performed before step c):

b1) arranging a further braided or coiled conductor on the casing layer, and b2) extruding an insulating, further casing layer around the further conductor, enclosing the further conductor, especially consisting of a thermoplastic elastomer.

A protective film of plastic, especially PTFE, may be disposed between the conductor and the casing layer, especially by means of banding or wrapping.

It may correspondingly be provided that a further protective film is disposed between the further conductor and the further casing layer. The core can be produced by extruding a core layer onto a cylindrical support element.

It is preferably provided that the compensating layer is extruded from foamed or foamable plastic.

The invention preferably provides that the cable is stretched at a stretching force of between 1% and 50% and especially 20% to 30% of the tensile strength of the cable.

The invention preferably envisages that the conductor is braided and has a braiding angle of 35° to 55°, especially 45°.

The invention further preferably envisages that the conductor has a covering of 70% to 90%, especially 80%.

It may be provided that the further conductor is braided and has a braiding angle of 30° to 50°, especially 40°.

The further conductor may have a covering of 50% to 80%, especially 65%.

In a preferred further development of the invention, it can be provided that a splaying member with rounded external contours is disposed inside the cable at a cable exit point of the cable, having a central passage opening from which an exit opening leaves, leading to the outside, the at least one electric conductor being guided through the passage opening into the splaying member, through the exit opening and out of it, and through which splayed cables are guided to the outside. This measure ensures that the conductor can be guided out of the cable at any point desired, without any risk of pinching or detaching the conductor if the cable is exposed to a tensile load.

In this context, it may be provided that the splaying member has an at least partially hollow, spindle-shaped cross-section in a longitudinal section plane containing a longitudinal axis of the cable. It is preferably provided that the exit opening is directed axially-radially at an outward slant. In addition, a protective collet may be disposed in the exit opening.

It is convenient for the splaying member to be secured in position in the cable.

BRIEF DESCRIPTION OF THE DRAWINGS

Further advantages and features of the invention will become clear from the following description of worked embodiments, reference being made to a drawing in which.

DETAILED DESCRIPTION OF THE INVENTION

Figure 1:
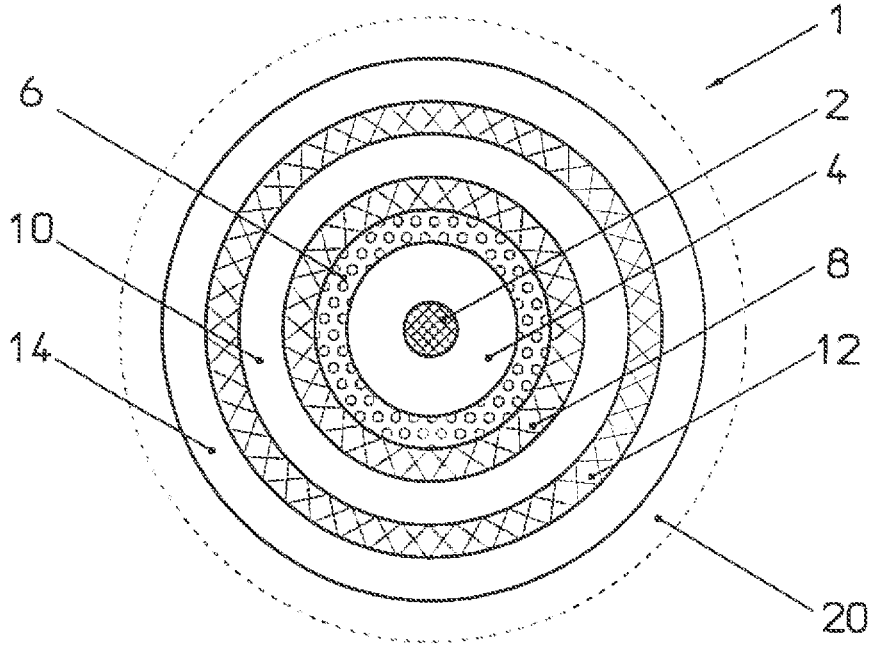
FIG. 1 shows a first embodiment of a cable to be contained in a braided plastic cable.

FIG. 1 shows the structure of a cable 1 in a cross-sectional illustration for coaxially arranging inside a braided plastic cable 20, which is merely indicated and which is to be thermally stretched together with the cable contained therein.

An insulating cylindrical core of the cable 1 includes a support element 2, consisting of a PA monofilament with a diameter of about 0.5 mm, on which is extruded a hard core layer 4 of PP with an external diameter of about 1.6 mm.

An insulating, resiliently compressible compensating layer 6 is extruded around the core formed in this way, which, in the example illustrated, may have an external diameter of about 2.2 mm+/−0.1 mm and may consist of foamed LD-PE. Alternatively, the compensating layer may consist of a thermoplastic elastomer, such as PE, PP, PVC or the like, which is combined with non-thermoplastic components, such as butadiene components. It is also possible to use cross-linked materials (with beta radiation, for example), e.g. PETE materials, in order to achieve high dimensional stability under heat, and also fluorine polymers.

Disposed coaxially around the compensating layer and the core located therein is a (first) conductor 8, which can have an external diameter of about 2.8 mm and may take the form of braiding. For example, 6×7 individual strands of galvanised copper with an individual cross-sectional area of 0.15 mm may be provided, which results in a total cross-sectional area of $42\times0.15\ mm^2=0.75\ mm^2$.

The pitch of the first conductor is preferably 8 mm, which corresponds to a braiding angle of 45°. The ideal covering is 80%.

Arranged concentrically around the first conductor 8 is an insulating (first) casing layer 10, enclosing the first conductor, with an external diameter of about 3.6 mm, which in particular is extruded as a hose. The first casing layer 10 can consist of a thermoplastic plastic or a thermoplastic elastomer.

A second (further) conductor 12 is arranged concentrically on the first casing layer 10 and, like the first conductor 8, preferably consists of braiding, which may have an external diameter of 4.25 mm. The second conductor 12 preferably consists of 6×7 individual strands of galvanised copper with an individual cross-sectional area of 0.15 mm, which results in a total cross-sectional area of $42\times0.15\ mm^2=0.75\ mm^2$. The pitch is preferably 10 mm, which corresponds to a braiding angle of 40°. The ideal covering is 65%.

Instead of braiding, both the first conductor and the second conductor may take the form of a twist screen, i.e. without crossovers, which in the event of any elongation of the cable, likewise offers the possibility that the conductor can be stretched in the longitudinal direction, reducing its diameter accordingly in the process.

A second (further) jacket 14 is arranged concentrically around the second conductor 12 and is preferably extruded from plastic as a hose. The external diameter of the second jacket 14 may be about 5.0 mm+/−0.1 mm. Like the first jacket 10, the second jacket 14 preferably consists of a high-temperature plastic, such as a thermoplastic plastic or a thermoplastic elastomer.

Figure 2:
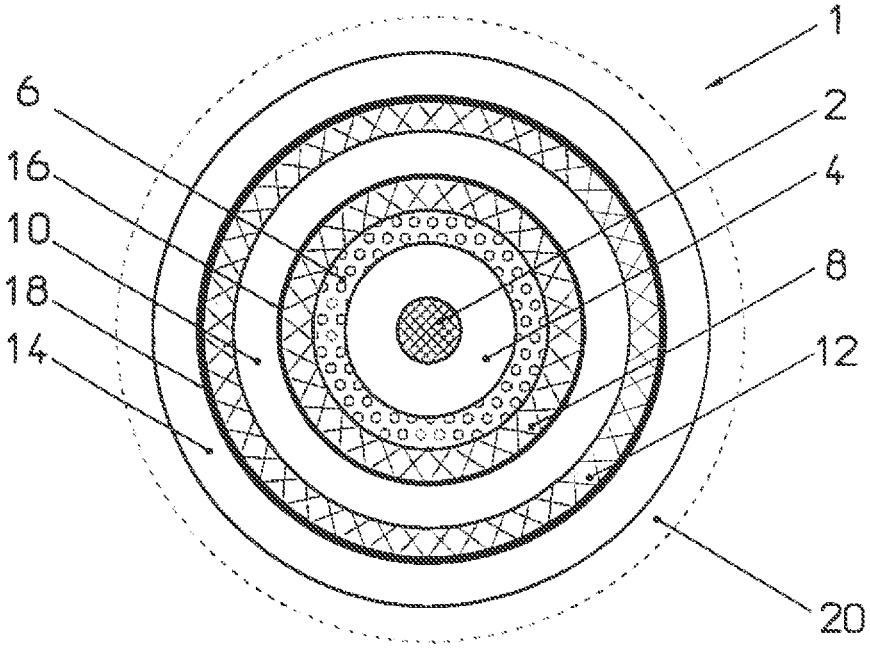
FIG. 2 shows a cross-section of a second embodiment similar to FIG. 1.
Figure 3:
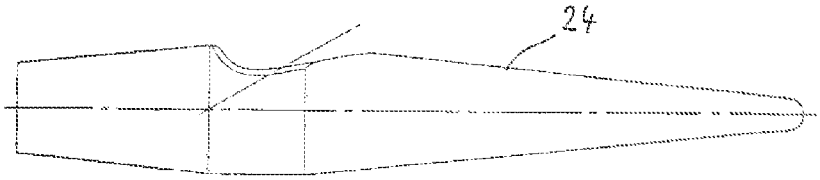
FIGS. 3 and 4 show a cable entry or exit with a rounded rigid splaying member.
Figure 4:
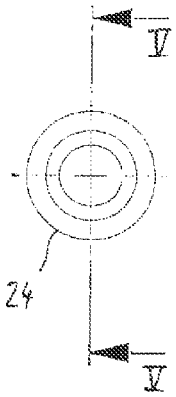
Figure 5:
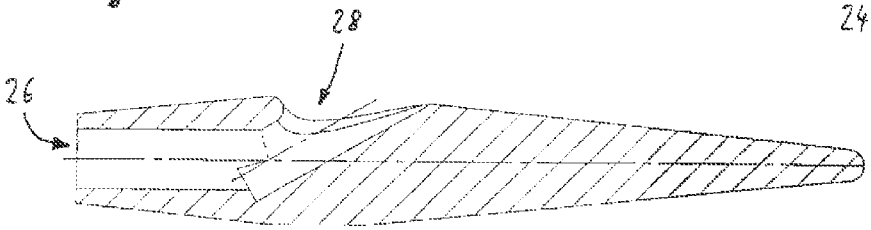
FIG. 5 is a cross-sectional view of the splaying member of FIG. 3.

In the embodiment according to FIG. 2, unlike the structure described above, it is provided that a (first) protective film 16 is arranged concentrically around the first conductor 8 and thus between the latter and the first casing layer 10. The first protective film 16 consists of a resistant plastic, especially PTFE with a thickness of about 0.05 mm, and may be extruded or, if it does not consist of extrudable material, coiled or banded.

In addition, it is provided that there is also a second (further) protective film 18 arranged around the second conductor 12, which is thus located between the latter and the second casing layer 14. This protective film, too, consists of a mechanically resistant plastic, preferably PTFE, which can withstand high temperatures and may be about 0.05 mm thick.

In an embodiment of this kind, the second casing layer 14 may have a somewhat larger external diameter of, for example, 5.1 mm+/−0.1 mm.

The protective films serve to provide security in the event that the insulation capacity of the first casing layer 10 and/or the second casing layer 14 is impaired by the subsequent process of thermally/mechanically stretching the cable.

A chemical fibre cable 20 is braided coaxially around the cable 1 (not to scale in the drawing regarding the diameter), e.g. in the form of 12-strand braiding (or with 16, 20, 24, 32 strands), each of which may be twisted from three wires, for example. The structure and thickness of the cable are determined by the mechanical requirements that can be expected (tensile load, torsional strain and bending stress).

After the production of the braided plastic cable 20 with the cable 1 contained therein, the two components, the cable together with the cable contained therein, are thermally stretched together. In the process, the cable is subjected to a stretching force of about 30% of the tensile strength of the cable at a temperature of about 90° C. to 120° C. In this process, the macromolecules of the chemical fibre material of which the cable consists, such as high-modulus polyethylene (e.g. the "Dyneema" brand), or aramide HMPA or an HMPES, is orientated in the longitudinal direction to a greater extent than was the case beforehand, so that the breaking strength of the cable is increased still further and also the elongation under tensile stress is reduced.

During this stretching process, the cable can be permanently stretched by 1% to 30% of its original length, e.g. by 10% of its original length.

Since the cable, which is braided in a hose-like manner, contracts radially during the stretching process, powerful compressive pressure is exerted on the cable, the effects of which on the conductor(s) can be very largely absorbed and compensated by the compensating layer 6. This is because the forces, which arise in a more or less uncontrolled and uneven manner, are compensated by the compressibility of the compensating layer. Crossover points in the conductor braiding, which exhibit greater thickness in the radial direction, are pressed locally into the compensating layer and thus remain undamaged. Local pressure peaks originating from the braided structure of the conductor and the wires of the cable are distributed and compensated.

In addition, the cable, like the braided cable itself, is subjected to elongation in the longitudinal direction, which can be especially critical for the metallic components of the conductor. Because of the arrangement of the conductor described, with an elongation reserve (braiding, coiling, twist screen or the like) this elongation can likewise be compensated.

As an example, one may consider a reduction in the diameter of the cable when there is a longitudinal elongation of 10%, based on the original unelongated length. The diameter of the core, including the compensating layer (layers 2, 4 and 6), in the embodiments described above is about 2.2 mm, which, assuming a constant volume (as an approximation, ignoring local compression of the compensating layer), results in a reduced diameter of about 2.10 mm at 10% elongation, which corresponds to a reduction by 0.10 mm. All the components located outside the core are likewise subjected to a reduction in diameter by about 0.1 mm. As an example, approx. 35% of the compensating layer consists of compressible volume (bubbles) and approx. 65% of a solid component.

With the conductor 8, 12 taking the form of braiding, as described, with a braiding angle of 45°, the coverage changes from about 80.8%, because of the reduction in the diameter of the core with a simultaneous increase in the pitch of the braiding, to about 81%, which is negligible. In the second conductor 12 too, the braiding coverage merely changes by 1%.

FIGS. 3 to 7 illustrate an appropriate solution to the problem of guiding a conductor, or the cable, running centrally in the braided cable through the cable braiding and to the outside without any risk of damage. A rigid splaying member 24 with rounded external contours inside the cable is arranged at a cable exit point 22 of the cable. The splaying member has a central passage opening 26, which extends at least from one end of the splaying member and into the latter. In the example shown in FIG. 6, the splaying member as a whole is hollow in form. From the passage opening 26, an exit opening 28 leading to the outside leaves in a substantially radial direction, the cable 1 being guided first through the passage opening 26 into the splaying member 24 and from there through the exit opening 28 out of the splaying member and through the splayed cable to the outside. The splaying member ensures that the cable is locally considerably larger in diameter than otherwise, so that the individual strands braided together and their crossover points take on an enlarged distance from one another, which makes it possible for the cable to pass through.

Even when the cable is subjected to a tensile load, nothing changes in this respect, i.e. the cable is not exposed to the risk of damage by being pinched off, or the like, by neighbouring strands of cable.

Figure 6:
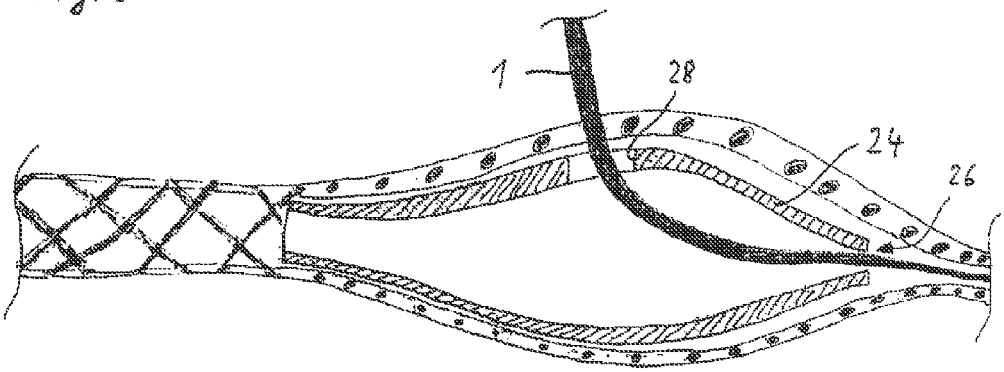
FIG. 6 is a partial cross-sectional view of another embodiment of the splaying member.
Figure 7:
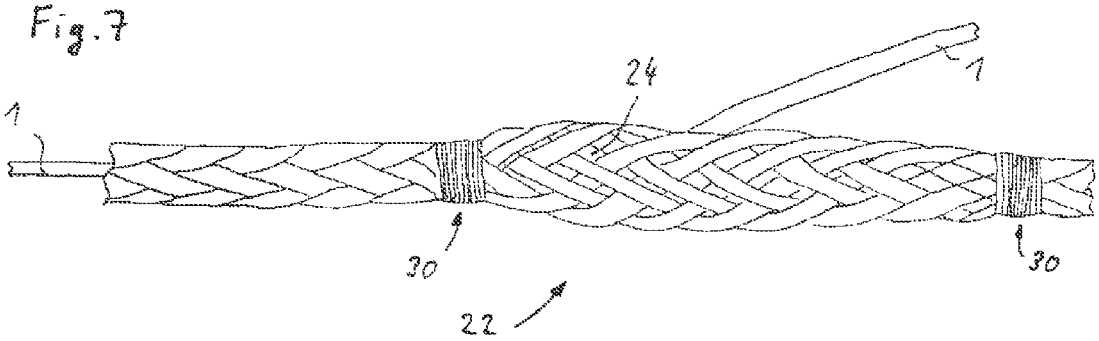
FIG. 7 is side plan view of the splaying member of FIG. 6.

FIGS. 6 and 7 show another embodiment of a splaying member 24, which is formed in a substantially spindle-shaped manner, with a passage opening 26 and an exit opening 28.

Where appropriate, the cable can be protected in the area of the exit opening and the neighbouring strands of cable by a protective collet, which may be partially contained in the exit opening.

The splaying member can be secure in position, by tacklings 30, for example.

REFERENCE NUMBERS

List of Reference Numerals

1 Cable
2 Support element
4 Hard core layer
6 Compensating layer
8 First conductor
10 First casing layer
12 Second conductor
14 Second casing layer
16 First protective film
18 Second protective film
20 Braided chemical fibre cable
22 Cable exit point
24 Splaying member
26 Passage opening
28 Exit opening

What is claimed is:

1. A braided chemical fibre cable thermally stretched together with a conductor comprising:

a cable having an interior and within the interior at least one electric conductor concentrically disposed around a core, a protective jacket being concentrically disposed around the conductor, wherein the protective jacket and the conductor have a positive-fit connection and the cable has a deformation caused by its accommodation of an external contour of the concentrically disposed conductor; and a cable exit positioned along a length of the braided cable, the cable exit point comprising a rigid splaying member positioned centrally within the braided cable through the cable braiding, the splaying member having a rounded external contour disposed entirely within the interior of the braided cable in the region of the cable exit point, the splaying member having a central passage opening in which an exit opening leads through a side of the braided cable to the outside, wherein at least one conductor is guided through the splaying member central passage opening, into and through the exit opening of the splaying member and to the outside through the cable braiding.

2. The cable as claimed in claim 1, wherein the cable further includes an insulating cylindrical core, an insulating compensating layer concentrcially enclosing the core, a first braided or coiled conductor concentrically arranged on the compensating layer, and a first insulating casing layer or jacket concentrically enclosing the first conductor.

3. The cable as claimed in claim 2, wherein a second braided or coiled conductor is concentrically arranged around the first casing layer, which is enclosed by a concentrically arranged second insulating casing layer or jacket.

4. The cable as claimed in claim 1, wherein the conductor is concentrically braided or coiled around the core.

5. The cable as claimed in claim 4, wherein at least the first and second conductors are guided through the splaying member central passage opening, into and through the exit opening of the splaying member and to the outside through the braided cable.

6. The cable as claimed in claim 2, wherein a protective film of plastic, which consists of PTFE, is concentrically disposed between the first conductor and the first casing layer.

7. The cable as claimed in claim 3, wherein a further protective film of plastic, which consists of PTFE, is disposed between the second conductor and the second casing layer.

8. The cable as claimed in claim 2, wherein the compensating layer is selected from a group consisting of foamed plastic, unfoamed plastic, a thermoplastic elastomer, and a combination of an elastomer and a thermoplastic material.

9. The cable as claimed in claim 1, wherein the protective jacket consists of extruded plastic, selected from a thermoplastic or a thermoplastic elastomer.

10. The cable as claimed in claim 1, wherein the core includes a support element in the form of a monofilament and a core layer extruded thereon.

11. The cable as claimed in claim 1, wherein the splaying member has an at least partially hollow, spindle-shaped cross-section in a longitudinal section plane containing a longitudinal axis of the cable.

12. The cable as claimed in claim 1, wherein the exit opening is directed axially-radially at an outward slant.

13. The cable as claimed in claim 1, wherein a protective collet is disposed in the exit opening.

14. The cable as claimed in claim 1, wherein the splaying member is secured in position within the braided cable.

* * * * *